US008395396B2

(12) United States Patent
Hagleitner

(10) Patent No.: US 8,395,396 B2
(45) Date of Patent: Mar. 12, 2013

(54) SANITARY DISPENSER WITH CAPACITIVE SENSOR

(76) Inventor: Hans Georg Hagleitner, Zell Am See (AT)

( * ) Notice: Subject to any disclaimer, the term of this patent is extended or adjusted under 35 U.S.C. 154(b) by 0 days.

(21) Appl. No.: 13/277,392

(22) Filed: Oct. 20, 2011

(65) Prior Publication Data

US 2012/0061415 A1 Mar. 15, 2012

Related U.S. Application Data

(63) Continuation of application No. PCT/AT2010/000102, filed on Apr. 14, 2010.

(30) Foreign Application Priority Data

Apr. 20, 2009 (AT) ..... A 601/2009

(51) Int. Cl.
*G01R 27/26* (2006.01)

(52) U.S. Cl. ..... 324/686; 73/862.337; 73/862.626; 340/562; 318/794; 318/795

(58) Field of Classification Search ..... 318/794, 318/817, 130, 400.03, 662, 751, 795, 796; 242/563.2, 564.4, 564, 565; 221/1, 13; 320/166; 324/382, 548, 661, 686; 327/61, 182, 183; 331/36 C, 177 V; 340/562; 73/862.337, 73/862.626

See application file for complete search history.

(56) References Cited

U.S. PATENT DOCUMENTS

| | | | | |
|---|---|---|---|---|
| 6,731,209 | B2 * | 5/2004 | Wadlow et al. | 340/562 |
| 6,838,887 | B2 * | 1/2005 | Denen et al. | 324/686 |
| 6,977,588 | B2 * | 12/2005 | Schotz et al. | 340/562 |
| 7,017,856 | B2 * | 3/2006 | Moody et al. | 242/564.4 |
| 7,182,289 | B2 * | 2/2007 | Moody et al. | 242/564.4 |
| 7,296,765 | B2 * | 11/2007 | Rodrian | 242/563.2 |
| 7,387,274 | B2 * | 6/2008 | Moody et al. | 242/564.4 |
| 7,793,882 | B2 * | 9/2010 | Reinsel et al. | 242/563 |
| 2005/0072874 | A1 * | 4/2005 | Denen et al. | 242/563 |

FOREIGN PATENT DOCUMENTS

DE 102007060402 A1 6/2009

* cited by examiner

*Primary Examiner* — Antony M Paul
(74) *Attorney, Agent, or Firm* — Laurence A. Greenberg; Werner H. Stemer; Ralph E. Locher

(57) ABSTRACT

A sanitary dispenser, particularly a paper or towel dispenser, contains a housing, in which a sanitary product to be dispensed and a discharge unit for the sanitary product to be dispensed can be arranged. An electric motor is provided for the discharge unit, the electric motor being activatable in a non-contact manner by a capacitive sensor from outside of the housing. The sensor capacitance of the capacitive sensor is formed by a planar electrode disposed inside the housing and by a surface of a body part and/or an object arranged outside of the housing.

21 Claims, 10 Drawing Sheets

SANITARY DISPENSER WITH CAPACITIVE SENSOR

CROSS-REFERENCE TO RELATED APPLICATION

This is a continuation application, under 35 U.S.C. §120, of copending international application No. PCT/AT2010/000102, filed Apr. 14, 2010, which designated the United States; this application also claims the priority, under 35 U.S.C. §119, of Austrian patent application No. A 601/2009, filed Apr. 20, 2009; the prior applications are herewith incorporated by reference in their entirety.

BACKGROUND OF THE INVENTION

Field of the Invention

The invention relates to sanitary dispensers, in particular paper or hand-towel dispensers, containing a housing in which a sanitary product which can be dispensed and a dispensing unit for dispensing the sanitary product. The dispensing unit contains an electric motor and is disposed in the housing. It is possible for the electric motor to be activated in a contactless manner by a capacitive sensor from outside the housing.

Particularly in public sanitary facilities, increased hygiene requirements have made it necessary to improve the hygiene which prevails and to prevent, or at least to reduce, the transfer of germs. In order to reduce the transfer of germs via the hands by contact with a wide variety of different objects in sanitary facilities, use is already being made of contactlessly operating toilet flushing, soap dispensers, urinals, hand driers or the like. These are actuated by contactlessly operating sensors, use being made predominantly of optical or magnetic sensors.

A further type of contactless sensor is formed by capacitive proximity switches, wherein advancing up a part of the body, for example a human hand, or other objects changes the associated electric field and thus also the sensor capacitance. This change is evaluated electronically and triggers a pulse for actuating the respective apparatus. One advantage of the capacitive proximity sensors is that they work independently of surrounding conditions, for example the light conditions, which are critically important for an optical sensor.

European patent EP 0 994 667, corresponding to U.S. Pat. No. 6,412,655, discloses a paper dispenser which has a dispensing unit which is actuated via a capacitive proximity sensor. The sensor capacitance is formed by a conventional plate capacitor with two planar electrodes within the housing wall. It is disadvantageous here that the weak marginal electric field of the two electrodes is not changed to any great extent by an individual advancing up, and therefore the sensor is not particularly sensitive. The dispensing unit is thus triggered only when the user's hand is moved in very close proximity to the sensor.

SUMMARY OF THE INVENTION

It is accordingly an object of the invention to provide a sanitary dispenser with a capacitive sensor which overcome the above-mentioned disadvantages of the prior art methods and devices of this general type, which has a contactlessly operating sensor which avoids the above disadvantages and, affected as little as possible by external influences, as a part of the human body is advanced up, makes sanitary products, e.g. paper towels, hand towels, soap or soap foam and the like, available in a dispenser opening of the housing by a dispensing unit, which is actuated electrically.

With the foregoing and other objects in view there is provided, in accordance with the invention a sanitary dispenser. The sanitary dispenser contains a capacitive sensor, a housing from which a sanitary product can be dispensed and defines a housing interior, and a dispensing unit for dispensing the sanitary product to be dispensed and disposed in the housing. The dispensing unit has an electric motor activated in a contactless manner by the capacitive sensor from outside the housing. A sensor capacitance of the capacitive sensor is formed by a planar electrode disposed in the housing interior, and a surface of a part of a body and/or of an object disposed outside the housing.

The capacitive sensor of the hand-towel dispenser according to the invention forms a sensor capacitance with a part of the human body which advances up. A planar electrode is arranged in the housing interior and the second conductor arrangement, to which the sensor capacitance relates, is formed by the conductive surface of a part of the body and, in addition or as an alternative, of an object arranged outside the housing. That is to say that the planar electrode and the advanced-up part of the body act like the two plates of a plate capacitor. In particular, in the absence of a part of the human body, the sensor capacitance relates to the capacitance between the planar electrode, which is arranged as the sensor surface in the housing interior, and the potential of the surroundings, that is to say, for example, of the earth's surface or of one of the walls or of the floor of the room in which the sanitary dispenser according to the invention is arranged.

If, then, a part of the human body, for example a human hand, advances up to the sensor surface, that is to say to the planar electrode, the sensor capacitance changes. The dispensing unit, or the electric motor of the dispensing unit, of the sanitary dispenser is then activated via an evaluation unit.

It may also be provided that the sanitary dispenser is of electrically insulated design, in particular if the electric motor of the dispensing unit is supplied with power by one or more batteries and does not have any direct electrical connection to an external potential, i.e. does not have any grounding.

In the case of a part of the body being advanced up and of the planar electrode being charged, these form the oppositely charged parts of a capacitor, i.e. the part of the body forms the second electrode of a capacitor. In particular, it may also be provided that the capacitive sensor in the housing interior, in the charged state, forms just one pole and there is no surface with electrically opposite charging provided in the housing interior.

If, then, there is no part of the body located within the detection range of the capacitive sensor, the sensor capacitance $C_S$ is provided by the planar electrode in the housing interior and by the materials located around the sanitary dispenser, and it therefore constitutes a basic capacitance $C_P$, also referred to as parasitic capacitance. The parasitic capacitance is exposed to external influences and therefore is not constant. Particularly important here are the ambient temperature, the air humidity and also contamination of the sanitary dispenser arranged in sanitary facilities, where the sanitary dispenser according to the invention can preferably be used, and therefore the changes in these parameters give rise to a different relative permittivity $\epsilon_R$, and this, in turn, changes the parasitic capacitance $C_P$. These ambient influences, however, give rise to a relatively slow change in the parasitic capacitance, since the ambient temperature and the air humidity do not change abruptly. Since installation requires that the area surrounding the capacitive sensor otherwise contains only materials with a low relative permittivity $\epsilon_R$, the influence of the external variables, that is to say, for example, of the air humidity and ambient temperature, is clearly evident.

If, then, a part of a user's body, for example the hand, advances up to the sensor region of the sanitary dispenser according to the invention, this produces an additional capacitance $C_H$ between the planar electrode and the object advancing up. The sensor capacitance $C_S$ which is the total capacitance measured by the capacitive sensor, is thus the sum of the capacitance $C_H$ produced by the part of the body advancing up and of the parasitic capacitance $C_P$.

It should be noted here that, even in the case of insulated sanitary dispensers which have no grounding, it is possible for an indirect electrical connection to be produced, this being realized by a capacitance between the potential of a part of the body of the person using the sanitary dispenser and the sanitary dispenser itself. Leakage currents are induced here in the sanitary dispenser and/or in the human body, these currents representing an ohmic resistance $R_K$ which is made up, inter alia, of body resistance, skin resistance, transfer resistance between the shoes and the floor, surface or material resistances of the floor in relation to the wall and to the surroundings, and by a number of material resistances and transfer resistances of the sanitary dispenser, and which can be modeled by a multiplicity of series and parallel resistors. Coupling fields giving rise to a capacitance $C_K$ are induced in addition. Overall, regions that are electrically conductive may be considered here as providing connection to electric resistors, whereas spaced-apart, i.e. non-connected surface regions may be regarded as being capacitors. However, this capacitance formed via coupling fields is already implemented in the additional capacitance $C_H$ or in the parasitic capacitance $C_P$.

Since just one planar electrode may be provided in the housing interior, and the electric field of the sensor capacitance is located largely outside the housing, or is oriented in this direction, the triggering or activation of the dispensing unit is markedly improved in relation to the prior art to the effect that the sensor is more sensitive and, for example, a human hand need not be advanced up just in the immediate vicinity of the capacitive sensor in order to cause a sanitary product to be dispensed. It is generally the case here that the greater the surface area of the sensor, the more extensive is this region of action.

In a particularly preferred embodiment of the invention, it is provided that the planar electrode is formed by a continuous metal layer, for example from copper or aluminum.

In the formula for a plate capacitor containing two parallel plates of surface area A spaced apart from one another by a distance d, the capacitance C is in direct proportion to the surface area A and indirect proportion to the distance d. Applied in general terms to the capacitive sensor according to the invention, of which the capacitance is formed by the planar electrode and, in the case of the dispensing unit being activated, by the surface of a part of the body which is being advanced up or has been advanced up, this means that the additional capacitance $C_H$ is in proportion to the surface area of the planar electrode and to the surface area of the part of the body. The greater the surface areas, the greater is also the change in the sensor capacitance $C_S$ on account of the addition of $C_H$ when a part of a user's body advances up to the sensor region of the capacitive sensor. In a preferred embodiment of the invention, the planar electrode is thus larger than 15 $cm^2$, preferably larger than 25 $cm^2$, e.g. 30 $cm^2$.

In a preferred embodiment of the invention, it is provided that the planar electrode is arranged at least parallel to the housing wall, wherein it may be particularly preferred if the planar electrode is arranged on the front side of the housing. This ensures that the electric field emanating from the sensor surface exits predominantly perpendicularly in the forward direction from the housing interior to the outside of the housing.

For the case where the housing is at least partially cylindrical, it may be advantageous if the planar electrode is adapted, at least in part, to this curved housing shape. It may be provided here that the planar electrode is formed in the interior of the housing, with the same curvature of the housing, at a constant distance therefrom. The planar electrode is preferably arranged in the region of a front dispenser opening, where the sanitary product is dispensed. In the case of a paper or hand-towel dispenser, this may be a dispenser edge which is an elongate, and possibly slot-like, opening in the housing. For a soap or soap-foam dispenser, it is also possible for the dispenser opening to be a tubular one.

Arrangement in the region of the front housing wall or of the front housing sides takes into account the main direction in which a part of the body is advanced up, since, for example, the user's hands are usually moved toward the sanitary dispenser from the front, or moved laterally past the dispenser, and the sensitivity for triggering or activating the dispensing unit is further improved. Arrangement in the vicinity of the dispenser opening improves this advantage further, since a human hand trying to take a sanitary product out of the sanitary dispenser according to the invention will move mainly in the direction of the dispenser opening.

In a preferred embodiment of the invention, the sensor surface, that is to say the planar electrode, is part of an oscillating circuit and is repeatedly charged to a potential and then discharges again via a resistor $R_d$. The resistor may be an individual resistor or a system of resistors. The dimensioning of $R_d$ here is adapted to the size of the planar electrode.

In a preferred embodiment, the oscillating circuit is a so-called relaxation oscillator. The charging state of the planar electrode is constantly compared with an internal reference voltage by straightforward electronic components, for example a comparator and flip-flops, wherein the charging operation is changed from charging to discharging, and vice versa, whenever the charging state of the planar electrode, that is to say the potential thereof, exceeds or drops below a certain value. At these points, the charging or discharging operation thus changes over.

It is particularly preferably provided here that the relaxation oscillator contains precisely one comparator. A relaxation oscillator configured in this way means that only a small number of electrical components are required, as a result of which production is more convenient and the susceptibility to defects decreases. It may be provided here that the comparator is already integrated in a microcontroller. It may also be provided that the comparator has an inverted output. The reference voltage, which prevails at one of the inputs of the comparator, can be picked up, for example, from the microcontroller.

In a preferred embodiment, the invention contains an evaluation unit, which determines the change over time in the sensor capacitance $\Delta C_s/\Delta t$ by the values measured by the capacitive sensor. For this purpose, it may provided that the evaluation unit has an electronic timer which, like the comparator, may be integrated in a microcontroller. Since the charging and discharging operations of the planar electrode are very short and the evaluation unit can evaluate very quickly the values communicated by the capacitive sensor, the time interval $\Delta t$ is so small (in the nanosecond to microsecond range) that essentially a differential capacitive change is evaluated. Therefore the basic value of the sensor capacitance, that is to say the parasitic capacitance, is insignificant in practice and the changes over time thereof as a result of external influences, for example temperature fluctuations or contamination of the sanitary dispenser, have no effect, precisely because the relevant differential change in the capacitance is negligible.

In a preferred embodiment of the invention, it is further provided that the time required for charging and/or discharging the planar electrode to a certain potential is compared with a reference time. It is possible here for the evaluation unit to have an internal timepiece and/or a further timer, which may likewise be integrated in the microcontroller. It may further be provided here that, rather than the charging and/or discharging time themselves being measured quantitatively, it is merely evaluated as to whether this time is more or less than the reference time. This is because, if a human hand advances up, the sensor capacitance $C_s$ increases and the charging and/or discharging time, that is to say the period taken for an entire charging cycle, is increased. Once again, rather than the capacitance itself, it is thus the change in the capacitance within a certain time interval which is evaluated. If, as a result of a human hand being advanced up, this differential change exceeds a certain value, over a certain period of time (in order to rule out individual discrepancies), the dispensing unit is activated. It is thus possible for this limit value to defined and stored in an electronic memory.

For adaptation to individual conditions, it is provided, in a preferred embodiment of the invention, that the sensitivity of the capacitive sensor can be adjusted. Since the sanitary dispensers according to the invention are used in different regions, where, for example, the air humidity fluctuates to a greater or lesser extent or where the range of the capacitive sensor is accessible to greater or lesser extent, it is thus possible to set whether the dispensing unit of the sanitary dispenser is activated in the case of a smaller or greater change in the sensor capacitance. It may be provided here that this limit value can be adjusted in a stepless manner.

In a further embodiment of the invention, it is provided that the sanitary dispenser is supplied with power by a battery. It is thus possible for the sanitary dispenser to be placed in position independently of the mains power supply, and this makes it easier, in particular, to retrofit such a sanitary dispenser.

The invention further relates to a method of dispensing sanitary products using a sanitary dispenser, wherein the sanitary dispenser may be configured as explained above. The sanitary dispenser contains a capacitive sensor and an evaluation unit, wherein the change over time in a sensor capacitance, which is formed by a, preferably planar, electrode, which is arranged in or on the sanitary dispenser, and the conductive surface of a part of the body and/or of an object arranged outside the sanitary dispenser, is determined. A dispensing unit, which is arranged in the sanitary dispenser and is operated by an electric motor, is activated on account of the change over time in the sensor capacitance.

As a result, it is not the capacitance itself which is evaluated, which may be problematic, in particular, on account of the changing parasitic capacitance $C_P$. Instead, the capacitive sensor and the evaluation unit react only to capacitive changes at certain time intervals, that is to say to changes over time in the sensor capacitance $C_S$, and this means that a capacitive movement sensor is realized. This allows a distinction to be made between a change in the sensor capacitance $C_S$ on account of a slow change in the parasitic capacitance $C_P$ and a quick change on account of a part of the body being advanced up, and spurious triggering on account of change in the parasitic capacitance $C_P$ can be avoided.

In order to be distinguished from a change in the parasitic capacitance $C_P$, the change over time in the sensor capacitance $C_S$ which is brought about by a part of the body being advanced up thus has to exceed a certain lower limit. In a preferred embodiment of the invention, it is provided that an upper limit for the change over time in the sensor capacitance $C_S$ is also present and is stored in an electronic memory in the sanitary dispenser, and therefore the electric motor of the dispensing unit is activated only when the change over time in the sensor capacitance $C_S$ lies between the upper limit and the lower limit. This has the advantage that large and small jumps in capacitance caused on account of disturbances from electrical units—for example light switches, dryers and the like—are detected by the evaluation unit as an interference signal, and spurious triggering, i.e. dispensing of the sanitary product without a part of the body being advanced up, is avoided.

A further cause of problems relates to contamination by water dripping off on the sanitary dispenser or soap residues, in the case of a soap dispenser, or wet paper or hand towels, in the case of a paper or hand-towel dispenser. Such contamination may result in an increase in capacitance which lies well within the above-described region between the lower limit and upper limit. The resulting increase in capacitance, however, diminishes only very slowly by the water on the sanitary dispenser, or the soap residues on the sanitary dispenser, dripping off and the wet paper, or the wet hand towels, drying. The action of a part of the body being advanced up causes an increase in capacitance which lies between the very slow increase as a result of ambient influences—for example the increase in temperature—and abrupt changes, for example as a result of disturbances from electrical units. In general here, the user's hand is guided in the direction of the sanitary dispenser and then away from the same again. In the interim, the hand is slowed down. This movement sequence gives rise, in the first instance, to an increase in the sensor capacitance $C_S$, which is followed by a short period of generally constant capacitance. The sensor capacitance $C_S$ then decreases again to the value prior to the hand being advanced up. Similar changes in capacitance also occur when the hand is moved past the sensor region at an essentially constant distance therefrom.

Since the sensor capacitance $C_S$ has essentially the same values before and after a part of the body is advanced up, it is provided, in a preferred embodiment of the method according to the invention, that the dispensing unit, or the electric motor of the dispensing unit, is activated only when the change over time in the sensor capacitance $C_S$ lies in the region between the upper limit and the lower limit and, in addition, in the time interval before and after this change over time, the sensor capacitance has essentially the same values. This time interval here may be between 0.2 s and 1.5 s, preferably between 0.2 s and 0.8 s.

For this purpose, however, it may also be provided that the dispensing unit is activated only when an increase in capacitance which lies between a lower limit and an upper limit is followed by a decrease in the capacitance by an amount which lies likewise between a lower limit and upper limit.

These measures allow the capacitive sensor or the evaluation unit to detect the difference both between an interference signal and a hand being advanced up and between contamination and a hand being advanced up. It may be provided here that this time interval is likewise stored in an electronic memory of the sanitary dispenser. It is also possible for the upper limit and/or the lower limit to be adjusted and/or stored in an electronic memory.

In a preferred embodiment of the method according to the invention, it is provided that, for the purpose of determining the change over time in the sensor capacitance, a charging period and/or a discharging period of the electrode are/is measured. It may be advantageous here if this measured period is compared with a reference time.

Other features which are considered as characteristic for the invention are set forth in the appended claims.

Although the invention is illustrated and described herein as embodied in a sanitary dispenser with a capacitive sensor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
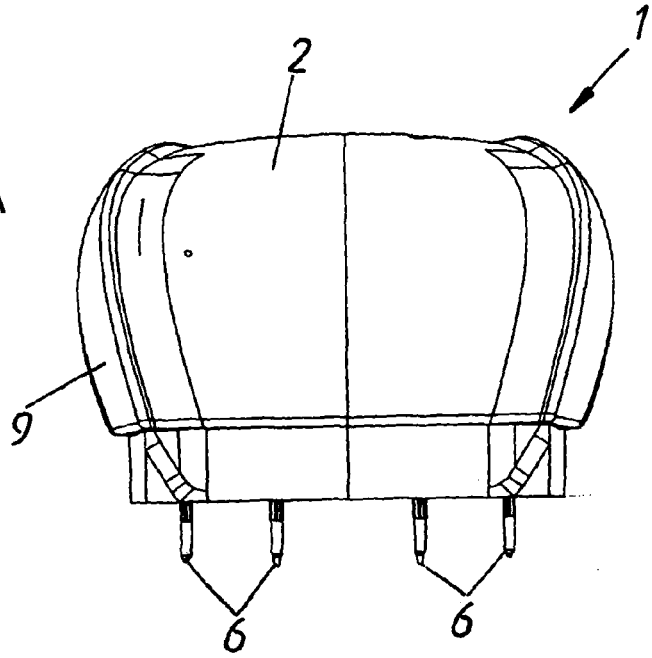
FIGS. 1A to 1D include a diagrammatic, plan view, side view, cross-sectional view and a perspective view, respectively, of a sanitary dispenser according to the invention configured as a paper dispenser.

Referring now to the figures of the drawing in detail and first, particularly, to FIG. 1A thereof, there is shown a plan view of a sanitary dispenser 1 according to the invention configured as a paper dispenser. FIG. 1A here illustrates an upper housing region 2 which, for the purpose of a sanitary product—in this case paper—being changed over, can be removed from the rest of a housing 9 and/or opened upward. Fastening devices 6, for example screws, are arranged in a rear region, in order that the sanitary dispenser 1 according to the invention can be mounted on a wall.

Figure 1B:
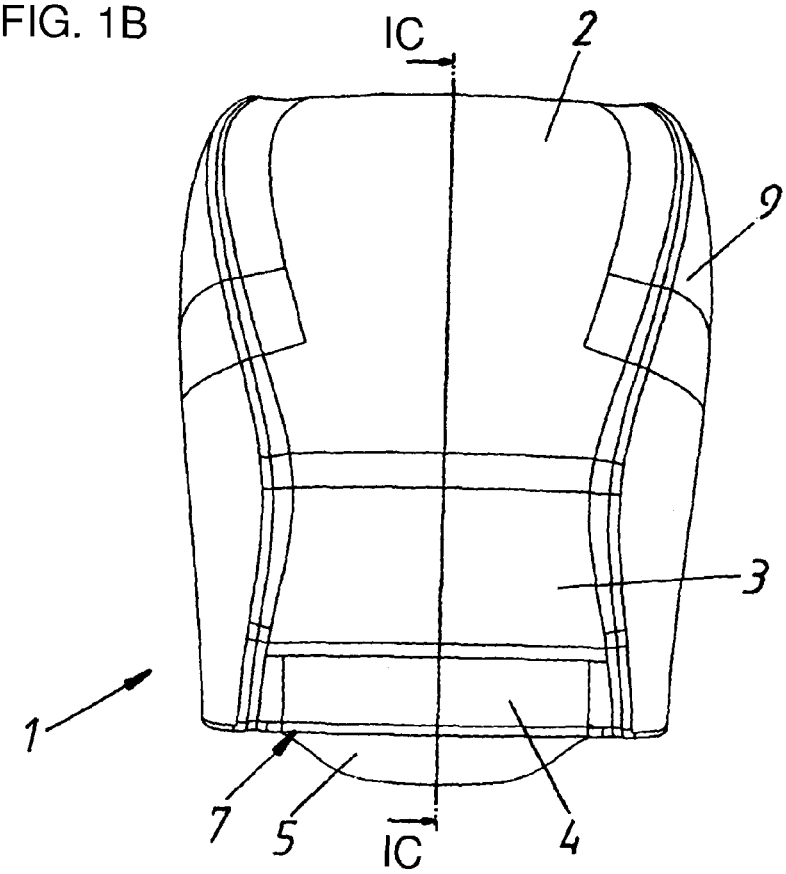

FIG. 1B illustrates a front view of the sanitary dispenser 1. In a lower region 3 of the housing 9, there being no need for this region to be removed for the purpose of changing over or refilling the sanitary product, a capacitive sensor 10 (see FIG. 1C), which has a planar electrode 11, is arranged behind a region 4 of the housing 9—that is to say in the housing interior. A dispensing unit 12 is arranged behind the region 3, the dispensing unit 12 feeding paper 13 and 15 from a roll 14, through a dispenser opening 7, in order that it can be removed there by a user. The region 4 is located in the vicinity of the dispenser opening 7. An emergency button 5, the function of which will be explained in more detail herein-below, is arranged on the underside of the dispenser opening 7.

Figure 1C:
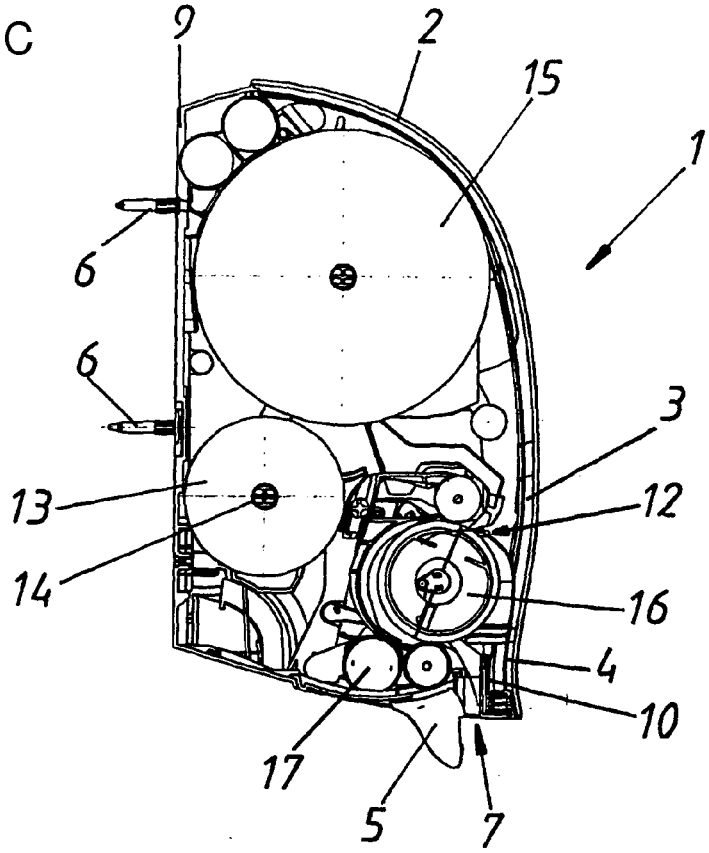

FIG. 1C illustrates a cross section of the paper dispenser from FIG. 1B taken along section line IC-IC. The sanitary product which is to be dispensed, in this case paper 13, is mounted on the roll 14. A further paper roll 15 is mounted as a reserve above the roll 14. The dispensing unit 12 contains a roller 16, which is operated by an electric motor 17, via gearwheels 18 (FIG. 2), and feeds the paper 13 through the dispenser opening 7. The capacitive sensor 10 is arranged behind the region 4 of the housing 9, the sensor activating the electric motor 17, and thus the dispensing unit 12, via a control unit 19 and thus feeding a unit of the paper 13 through the dispenser opening 7. For this purpose, the roller 16 has arranged on it a cutter which, for example during each revolution, perforates or severs a sheet of paper 13 in order that a user can easily remove or tear off the same. After the dispensing unit 12 has been activated once, the roller 16 continues rotating until a piece of the next unit of paper 13 projects through the dispenser opening 7. If it is only malfunctioning, e.g. as a result of paper jam, or if the dispensing unit 12 is not triggered, for example on account of malfunctioning of the capacitive sensor 10, there is an emergency button 5 present, the actuation of which uncouples the motor 17 from the dispensing unit 12 and rotates the roller 16 manually to the extent where a unit of paper 13 can be removed.

For the sake of clarity, further details of the sanitary dispenser 1 illustrated have not been provided with designations or have not been illustrated. The dispensing unit 12 and the emergency button 5 for such a paper dispenser are known per se in the prior art and disclosed, for example, in U.S. patent publication No. 2007/0079684 which is herewith incorporated herein. The functioning of the capacitive sensor 10 according to the invention, however, rather than being limited to the paper-dispenser exemplary embodiment illustrated here, can be used in general for sanitary dispensers 1 with the electrically operated dispensing unit 12.

Figure 1D:
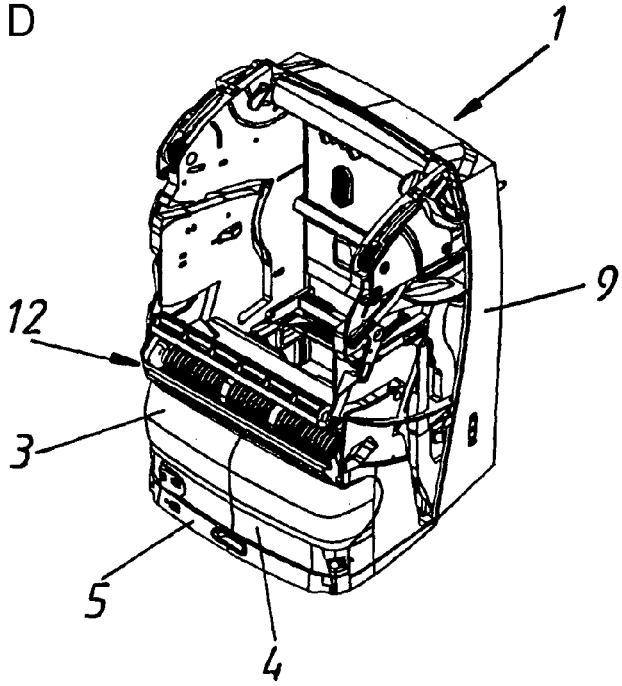

FIG. 1D illustrates a perspective view of the sanitary dispenser 1, wherein the region 2 of the housing has been removed and there are no sanitary products arranged in the housing interior. This is the situation which is present when the sanitary dispenser 1 is being refilled.

Figure 2:
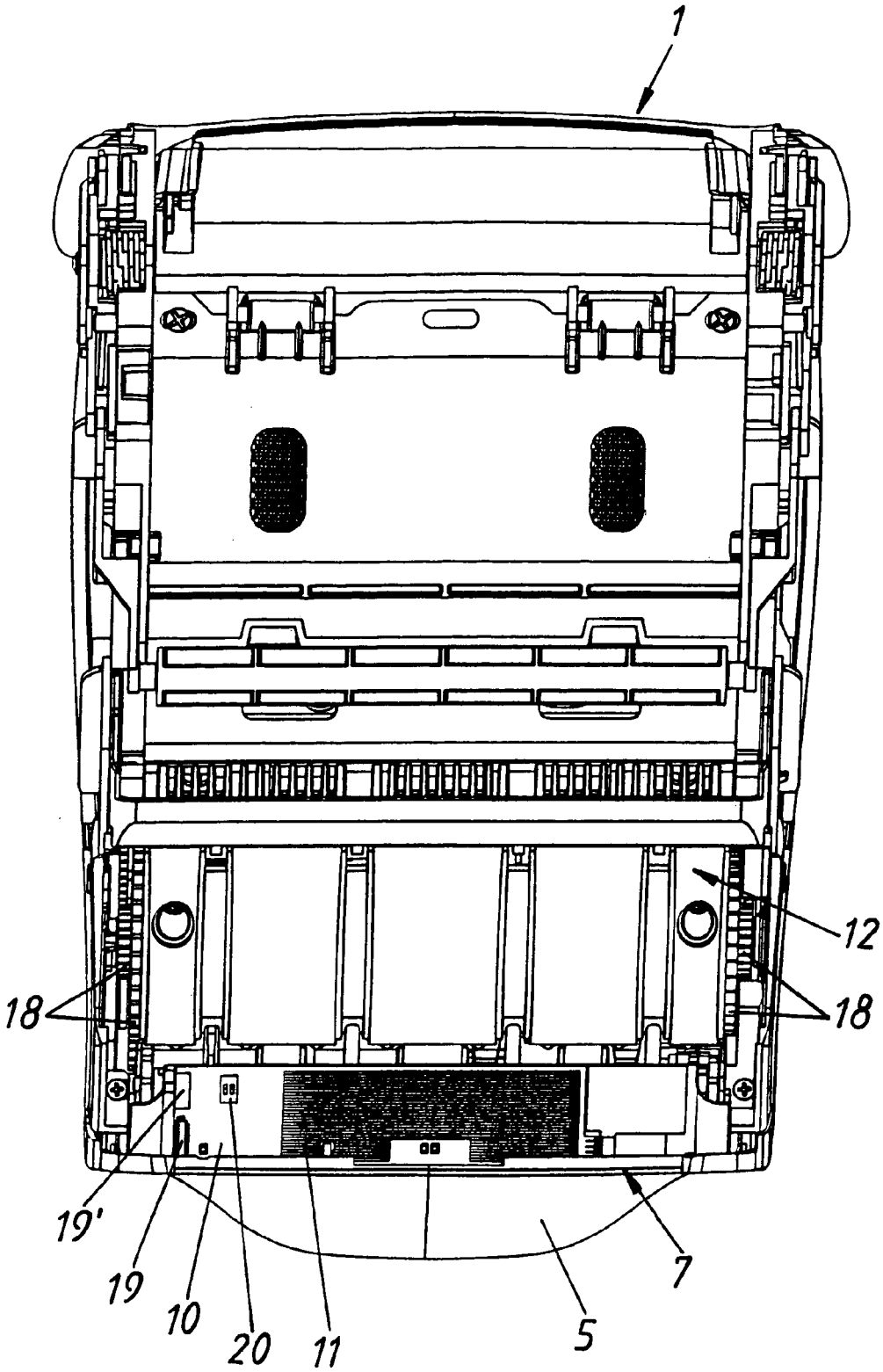
FIG. 2 is a front view of the sanitary dispenser according to the invention configured as a paper dispenser, but without an outer housing wall.

FIG. 2 shows a front view of a housing interior of the sanitary dispenser 1 according to the invention. FIG. 2 illustrates the gearwheels 18, which are connected, on the one hand, to the motor 17 and the roller 16 and, on the other hand, to the emergency button 5, in order for the paper 13 to be fed through the dispenser opening 7 by the roller 16. The capacitive sensor 10 according to the invention is arranged in the housing interior in the vicinity of the dispenser opening 7, wherein the electronics of the capacitive sensor 10 may contain the planar electrode 11 and a microcontroller 24, with the integrated evaluation unit 19' and the integrated control unit 19, and have a switch 20 for activating the capacitive sensor 10. The electronics also have a plug-in connection by which the electronics can be connected to the motor 17, the batteries or an external power source or the like. The planar electrode 11 here has a surface area of more than 25 $cm^2$, for example 30 $cm^2$. This means that a large surface area is available, in order that the sensor capacitance $C_S$ is adequately distinguished from the parasitic capacitance $C_P$ when a user's hand 21 advances up to the capacitive sensor 10 (see FIG. 4A).

Figure 3A:
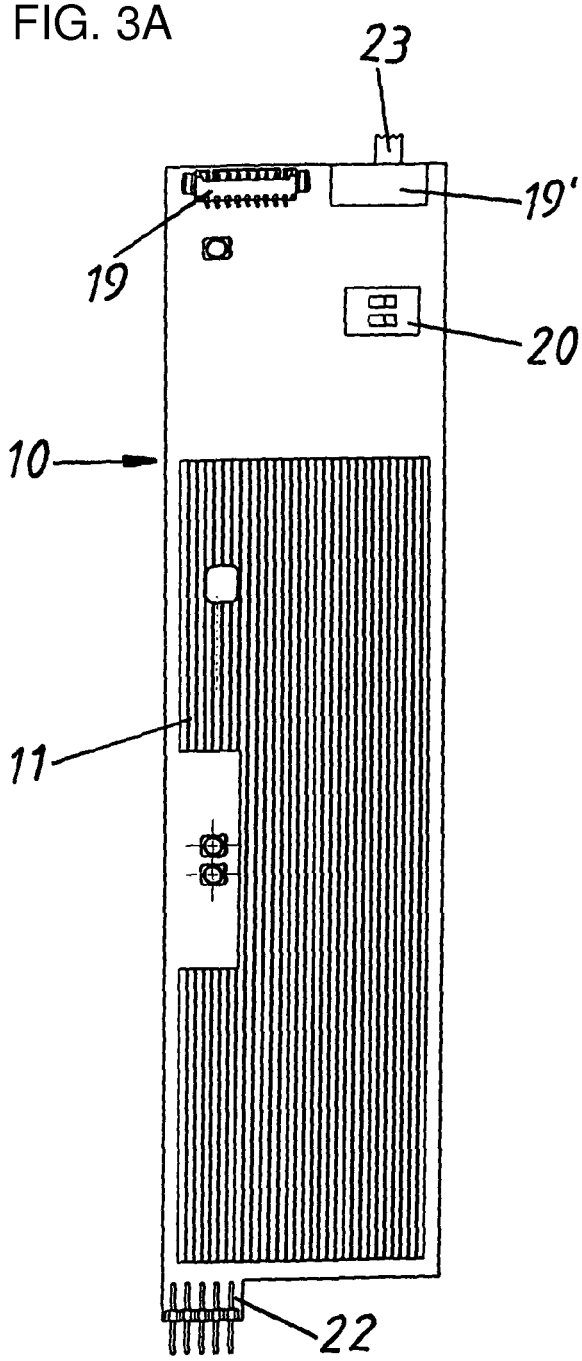
FIGS. 3A to 3D include a plan view, two side views and a perspective view respectively of a capacitive sensor according to the invention.

FIG. 3A shows a plan view of the capacitive sensor 10 together with its electronics. The planar electrode 11 is arranged over much of the sensor 10, the electrode being hatched in this case, but consisting of a continuous planar metal layer.

Figure 3B:
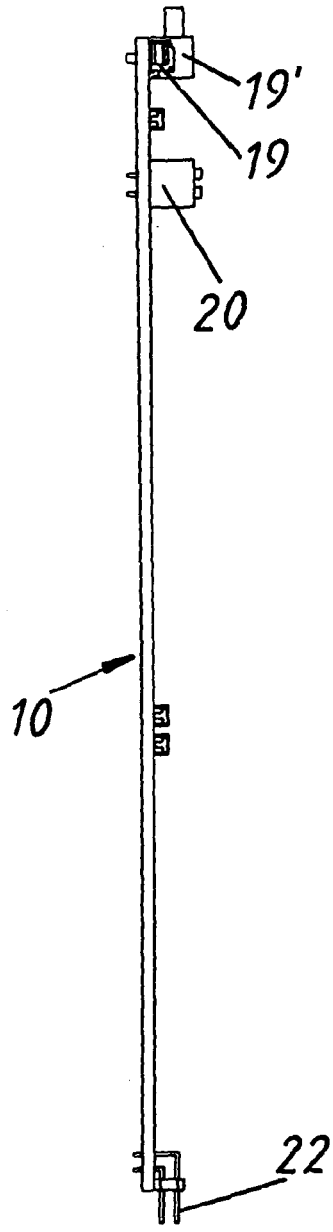
Figure 3C:
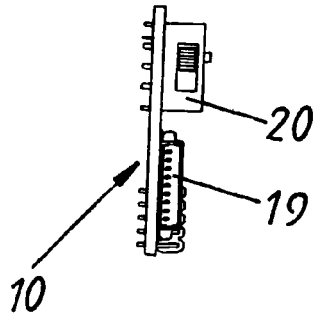
Figure 3D:
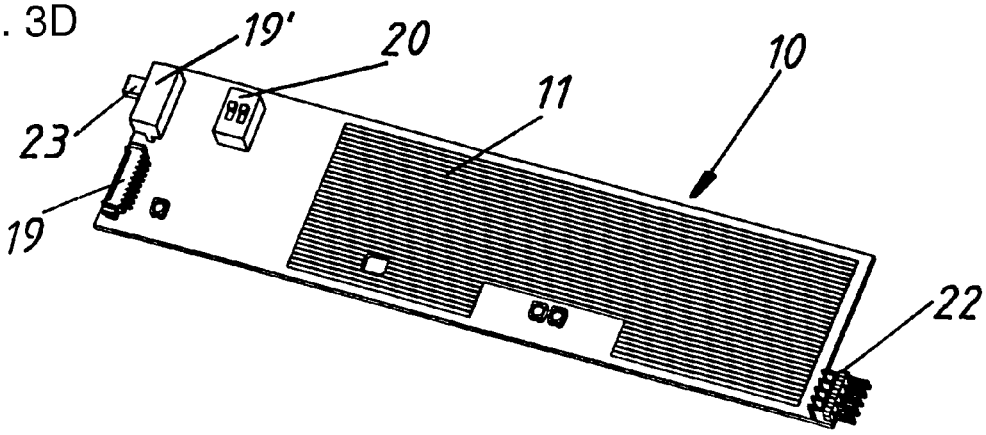

The electronics of the capacitive sensor 10 can be activated by the switch 20. These electronics contain the microcontroller 24 with the integrated evaluation unit 19' and the integrated control unit 19, which may also be configured as a common component. The control unit 19 communicates the control commands to the dispensing unit 12 via connections 23 and/or plug-in connections 22. Via a further connection, the sensor 10 can be supplied, for example, with power and, in addition or as an alternative, exchange control commands. FIGS. 3B and 3C show side views of the capacitive sensor 10 with its electronics. FIG. 3D illustrates a perspective view of the sensor 10 with its electronics, wherein the sensor 10 is very narrow and can thus easily be arranged behind the region 4 of the housing 9. In the case of cylindrical housings 9, however, it would also be possible for the planar electrode 11 likewise to be cylindrical. The region of the capacitive sensor 10 alongside the planar electrode 11 contains the electronic component, e.g. the microcontroller 24 with the integrated evaluation unit 19' and the control unit 19, as well as further adjusting elements and the plug-in connection 22. The microcontroller 24, which is not illustrated explicitly in FIGS. 3A to 3C, is known per se in the prior art and therefore it need not be explained in any more detail.

Figure 4A:
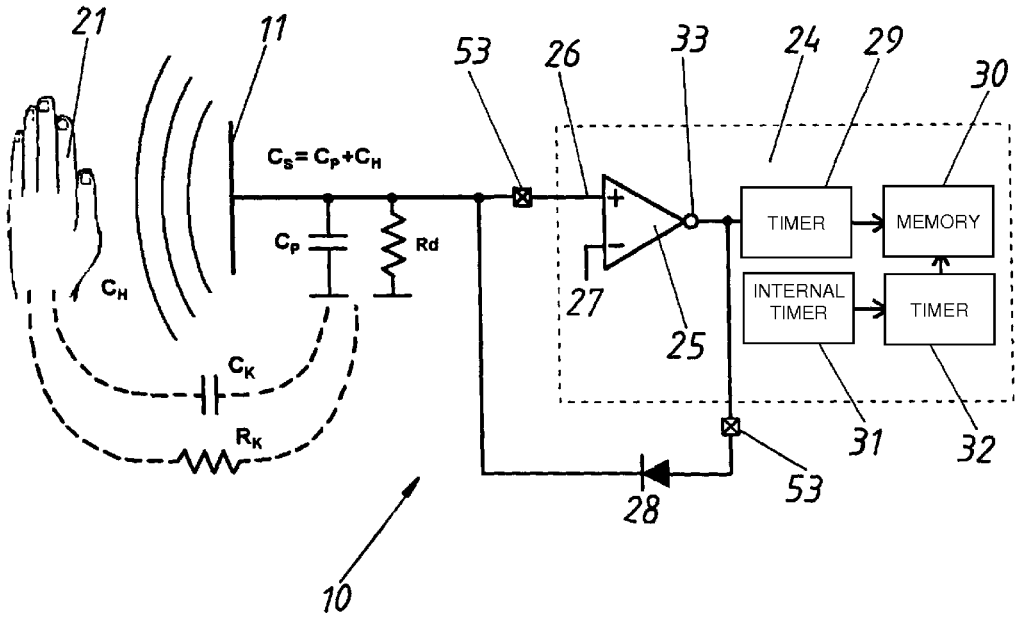
FIGS. 4A and 4B are a schematic illustration of a functioning of an exemplary embodiment of the capacitive sensor according to the invention with an evaluation unit, and a graph illustrating voltages at an output and at an input of a comparator of the capacitive sensor according to the invention.

FIG. 4A shows a schematic construction of the circuit and of the hardware modules necessary for the capacitive sensor 10 according to the invention and gives an illustration of the function of the same. The planar electrode 11 is shown on the left-hand periphery of the capacitive sensor 10, this electrode forming the sensor capacitance $C_S$ together with the surface of a hand 21 and/or of an object arranged outside the housing. Without a hand 21 being advanced up, the sensor capacitance $C_S$ contains only the parasitic capacitance $C_P$. The action of the hand 21 being advanced up adds to the parasitic capacitance $C_P$ the capacitance between the hand 21 and the planar electrode 11 $C_H$, and therefore the sensor capacitance $C_S$ is the sum of $C_P$ and $C_H$. This change in the sensor capacitance $C_S$ is detected by the capacitive sensor 10 according to the invention, which results in the dispensing unit 12 being triggered and a sanitary product, that is to say, for example, a sheet of paper 13, being dispensed. Furthermore, there are also two terminals 53, which are formed, for example, by the limbs of the microcontroller 24. All the components arranged within the dashed line are hardware elements of the microcontroller 24.

A positive, non-inverted input 26 of a comparator 25 is connected to the planar electrode 11 and to the cathode of a diode 28. An internal reference voltage, for example a direct voltage of 0.6 V, prevails at a negative input 27 of the comparator 25. An inverted output 33 of the comparator is connected to the anode of the diode 28. The planar electrode 11 is discharged via a resistor $R_d$. The size of the resistor $R_d$ is adapted to that of the planar electrode 11. The direction of installation of the diode 28 causes the planar electrode 11 to be charged via the diode 28. This arrangement gives rise to a so-called relaxation oscillator, with precisely one comparator 25. The planar electrode 11 is part of this oscillating circuit and determines the frequency thereof by the time constants $\tau$, the frequency for oscillating circuits generally being the product of resistance and capacitance.

If this circuit is then supplied with a voltage, wherein the supply voltage, in an exemplary embodiment, may be a direct voltage of 5 V, the oscillating circuit, in the first instance, has to settle down since, at the start, 0 V prevail at the two inputs 26, 27 of the comparator 25. For the sake of better clarity, the voltage source itself does not feature in this schematic illustration. After a short time, the internal reference voltage, which may be, for example, between 0.4 V and 1.5 V, preferably approximately 0.6 V, prevails at the negative input 27 of the comparator 25, whereas the positive input 26 is still at 0 V. The comparator 25 compares the two voltages with one another and switches the inverted output 33 to "HIGH", i.e. the supply voltage, that is to say, for example, a direct voltage of 5 V, prevails at the output 33, because the difference between the voltages at the inputs 26, 27 of the comparator 25 is negative. The diode 28 then becomes conductive, as a result of which the planar electrode 11 is charged and a sensor capacitance $C_S$ forms. Although the charging operation should last only until the difference between the two voltages prevailing at the inputs of the comparator 25 is positive, the inertia of the comparator 25 (response time) means that the planar electrode 11 is charged essentially to the supply voltage, that is to say, for example, to a direct voltage of 5 V, which then likewise prevails at the positive input 26 of the comparator. It is only then that the comparator 25 reacts and switches the inverted output 33 to "LOW", i.e. 0 V prevail at the output 33. The diode 28 then blocks and the planar electrode 11 begins to discharge via the resistor $R_d$. If the voltage at the positive input 26 of the comparator 25 thus decreases to a value smaller than the internal reference voltage, which prevails at the negative input 27 of the comparator 25, then the charging operation of the planar electrode 11 begins anew. This relaxation oscillator thus causes the planar electrode 11 to be constantly charged and discharged, wherein the electrode 11 can be charged up to the supply voltage and discharged down to the reference voltage.

It may be provided here that the charging pulses at the output 33 of the comparator 25 are only very short and discharging via the resistor $R_d$ takes place relatively slowly, and therefore a sawtooth voltage arises from the charging of the planar electrode 11. The critical factor here is that, with the sensor capacitance $C_S$ remaining the same, the time between the charging pulses, i.e. the time between the comparator 25 being switched over from "LOW" to "HIGH", and vice versa, is constant. If an object then moves into the vicinity of the planar electrode 11, that is to say into the vicinity of the capacitive sensor 10, the sensor capacitance $C_S$ increases by the addition of $C_H$, as a result of which the discharging operation takes longer, since the time constant $\tau$ of the oscillating circuit is a product of the resistance $R_d$ and of the sensor capacitance $C_S$. The sensor capacitance $C_S$, which has been supplemented by the addition of $C_H$, also includes here the capacitance $C_K$ induced by coupling fields, these being imparted by the surroundings of the user's hand 21 and by the surroundings of the sanitary dispenser 1. Leakage currents, represented by the resistance $R_K$, flow through electrically conductive regions of these surroundings, whereas spaced-apart surface regions form capacitances which are given, in total, by the capacitance $C_K$. Therefore, the greater the sensor capacitance $C_S$, the greater the time constant $\tau$, as a result of which the discharging operation lasts longer. This general principle makes it possible to detect the sensor capacitance $C_S$ which changes on account of a hand 21 being advanced up.

Furthermore, the capacitive sensor 10 has a first timer 29, an electronic memory 30, in which a software module is stored, an internal timepiece 31 and a second timer 32. The internal timepiece 31 and the timer 29, 32 are constructed from electronic components which are known per se. These components 29, 30, 31, 32, like the comparator 25, may be integrated in a microcontroller 24, which may be part of an evaluation unit 19' which evaluates the measured values, that is to say, for example, the measured times where the charging period and/or the discharging period of the planar electrode 11, and activates the dispensing unit 12, or the electric motor 17 of the dispensing unit 12, via the control unit 19.

Figure 4B:
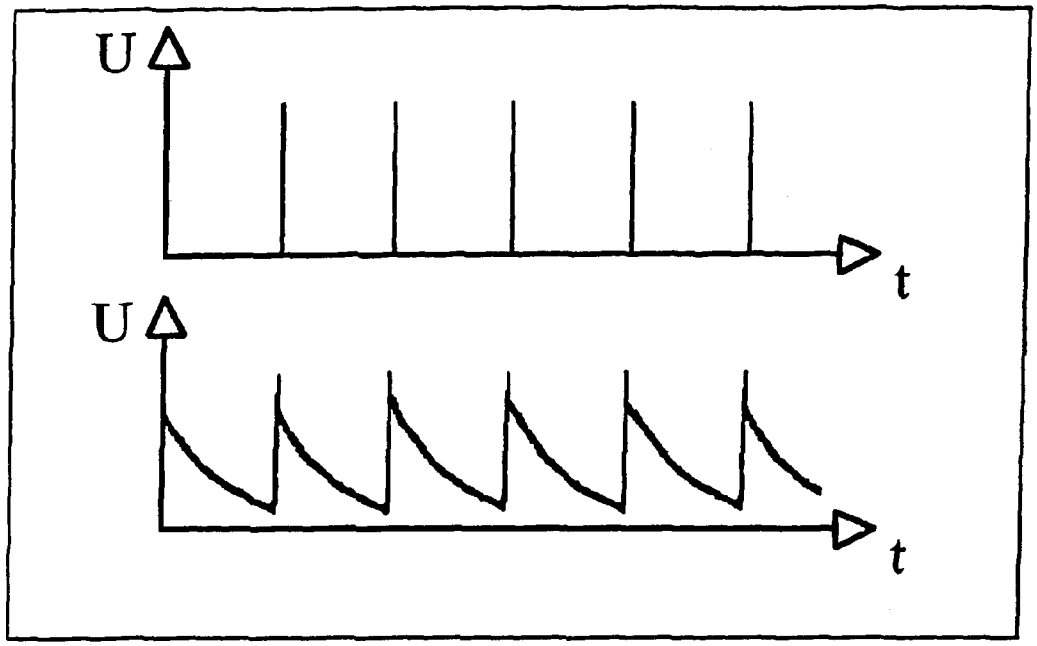

In FIG. 4B, the upper diagram illustrates a voltage over the course of a number of charging cycles at the output 33 of the comparator 25. It is clearly evident here that the charging period is, i.e. the charging pulses are, only very short. The lower diagram illustrates the voltage at the input 26 of the comparator 25 over the course of a number of charging cycles. The discharging operation running in accordance with the time constant is clearly evident, wherein the charging operation begins in each case when the voltage drops below a certain value and the relaxation oscillator thus changes over.

Figure 5:
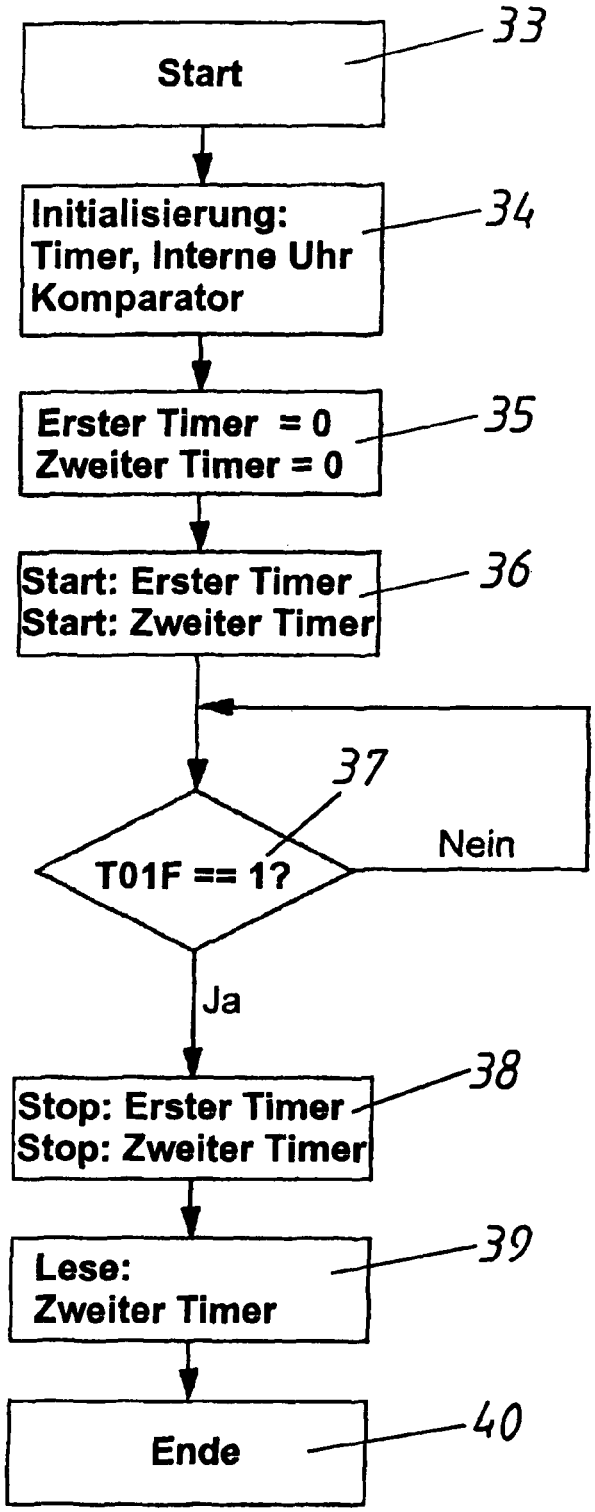
FIG. 5 is a flow diagram for illustrating an exemplary embodiment of the method according to the invention.

FIG. 5 illustrates a flow diagram to show how software stored in the electronic memory 30 evaluates the measured values. After the start 33 of the evaluation, which can be activated, for example, by the switch 20, in a step 34, the system is initialized and the two timers 29, 32 and the comparator 25 are supplied with power. The first timer 29 here is fed by the charging pulses of the comparator 25, whereas the second timer 32 is fed by the internal timepiece 31, which functions as a clock generator. The periods for charging and discharging the planar electrode are very short, and it is therefore also the case that, during a change in value in the sensor capacitance $C_S$ as a result of a hand 21 being advanced up, a number of charging pulses take place and the charging and/or the discharging period is measured a number of times. In a step 35, the two timers 29, 32 are zeroed. Depending on the embodiment, these timers can count up to different maximum levels. If twelve bit timers are provided for the two timers 29, 32, both can count from 0 to 4,095. After this maximum value, the respective timer runs over and starts at zero again. Of course, it is also possible to use timers 29, 32 with other maximum values, i.e. a different bit structure.

The first counter 29, which is fed from the inverted output 33 of the comparator 25, increases its counter reading at each ascending flank of the output voltage of the comparator 25, that is to say each time a charging operation of the planar electrode 11 begins. It is also conceivable for the counter reading to be increased each time the flank descends. This makes it possible to measure the entire charging-cycle period, i.e. the charging period and discharging period of the planar electrode 11. However, since, also on account of the dimensioning of the components, the charging period is shorter by a multiple than the discharging period, the total charging period corresponds essentially to the discharging period. That is to say, the time that is necessary for charging purposes is very short in comparison with the time that is necessary for discharging purposes, given by the time constant $\tau$, and can thus be considered to be constant or even negligible. Of course, it is also nevertheless conceivable for the charging and discharging periods to be measured and evaluated separately by electronic components which are known per se.

If, then, the first timer 29 reaches its maximum level, that is to say, for example, 4,095, it runs over, the overrun bit T01F of the first timer 29 thus being set to one. In a step 37, the value of this overrun bit is interrogated on a constant basis. As soon as the value has changed from zero to one, in a next step 38, the second timer 32 is stopped. Since this second timer 32 is fed by an internal timepiece 31, and its counter reading thus increases in accordance with the clock predetermined by the internal timepiece 31, the counter reading of the second timer 32 is read, in a step 39, to give a time value. This time value corresponds to the time for a number of charging cycles of the planar electrode 11 which correspond to the maximum value of the first counter 29, i.e., in this case, how much time has elapsed until the planar electrode has been discharged 4,096 times. Since this period is dependent on the magnitude of the sensor capacitance $C_S$, it is thus possible to detect a change in the sensor capacitance $C_S$, in particular a change over time in the sensor capacitance $C_S$, since the evaluation unit 19' stores, in the electronic memory 30, the counter reading of the second timer 32 which has been read in the step 39 and compares this with earlier values or with reference values stored in the memory. Since a charging cycle of the planar electrode 11 ranges from nanoseconds to not more than a few microseconds, it is possible for a very large number of read-out operations to be implemented for the second timer 32 as a hand 21 is being advanced up, and therefore the average change over time $\Delta Cs/\Delta t$ in the sensor capacitance $C_S$ which can be determined thereby corresponds, in practice, to the differential change $dC_S/dt$ in the sensor capacitance $C_S$.

Figures 6A, 6B:
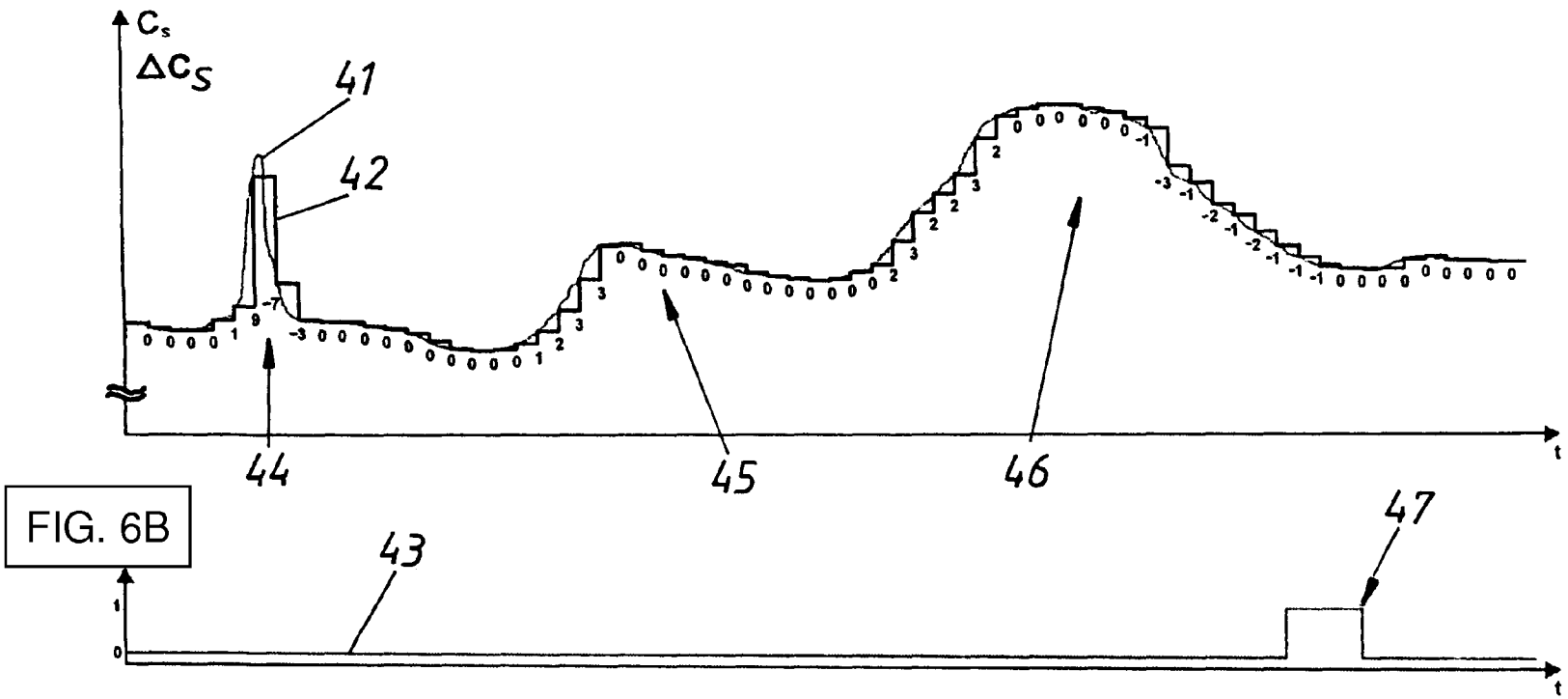
FIGS. 6A and 6B are graphs for explaining when the dispensing unit of the sanitary dispenser according to the invention is activated.

FIG. 6A illustrates the variation in the sensor capacitance $C_S$ over a certain period of time by way of a smooth curve 41. The step-like curve 42 illustrates the change $\Delta C_S$. The numerical values beneath this curve 42 indicate, in a relative unit, the respective increase and/or the respective decrease in the sensor capacitance $C_s$ in relation to the previously determined value. In FIG. 6B, the curve 43 constitutes the control signal communicated from the control unit 19 to the electric motor, this signal being illustrated as a binary signal. As long as this signal is at 0, there is no activation of the motor 17. If the control signal jumps to 1, the electric motor 17 of the dispensing unit 12 is activated, as a result of which a unit of the sanitary product which is to be dispensed is dispensed.

The software stored in the electronic memory 30 makes it possible for the capacitive sensor 10 nevertheless to be able to distinguish between an interference signal or a contamination and to be activated only in the case of a part of the body being advanced up to the electric motor 17. A region 44 of FIG. 6A shows disturbance from electrical units, for example a dryer located in the vicinity of the sanitary dispenser 1 according to the invention, this disturbance giving rise to a very high and short jump in capacitance. This abrupt change in capacitance of +9 and −7 units is outside the upper and lower limits for changes in capacitance stored in the electronic memory 30. It is only when the change in the sensor capacitance $C_S$ lies between this upper limit and lower limit that triggering can take place. Basically no triggering takes place outside this upper limit and lower limit. This disturbance therefore does not give rise to any triggering action.

A region 45 of FIG. 6A illustrates a situation which arises typically as a result of a sanitary dispenser 1 being contaminated by water, wet paper or, for example, soap residues. In this region 45, there is previously a weak increase in capacitance by one to three units, this increase lying basically between the upper limit and lower limit for admissible changes in capacitance. In this exemplary embodiment of the invention, however, it is provided that the electric motor 17 is activated only when the sensor capacitance $C_S$ drops again, within a relatively short period of time, to the value prevailing prior to the increase. In this region 45, however, it can be seen that the increase in capacitance which has previously taken place is diminished only very slowly, since the wet paper dries relatively slowly or water or soap is slow to drip off. It is thus possible for the software stored in the electronic memory 30 to interpret this as contamination and not to activate the dispensing unit 12.

A region 46, then, shows the situation which arises when a hand 21 advances up to the sensor 10. This advancing action causes the capacitance to increase by between two and three units. The hand 21 is then slowed down, as a result of which, in the region of a local maximum, the sensor capacitance $C_S$ is essentially constant and there is no change determined by the evaluation unit 19'. Thereafter, the hand 21 moves some way away from the sensor 10 again, for example in the direction of the dispenser opening 7, as a result of which the sensor capacitance $C_S$ decreases again. Both the changes during the increase in capacitance and those during the decrease in capacitance lie within the region predetermined by the lower limit and upper limit, wherein the amount is critical for the decrease in capacitance. It may be provided here that the software evaluates this feature as a hand being advanced up and activates the dispensing unit 12. In this exemplary embodiment, however, it is provided that the fact that essentially the same values for the sensor capacitance $C_S$ occur, in addition, before the increase in capacitance and after the decrease in capacitance is interpreted by the software as a hand 21 being advanced up, and therefore, in the region 47 of FIG. 6B, the dispensing unit 12 is triggered by a control signal from the control unit 19 activating the electric motor 17.

Figure 7:
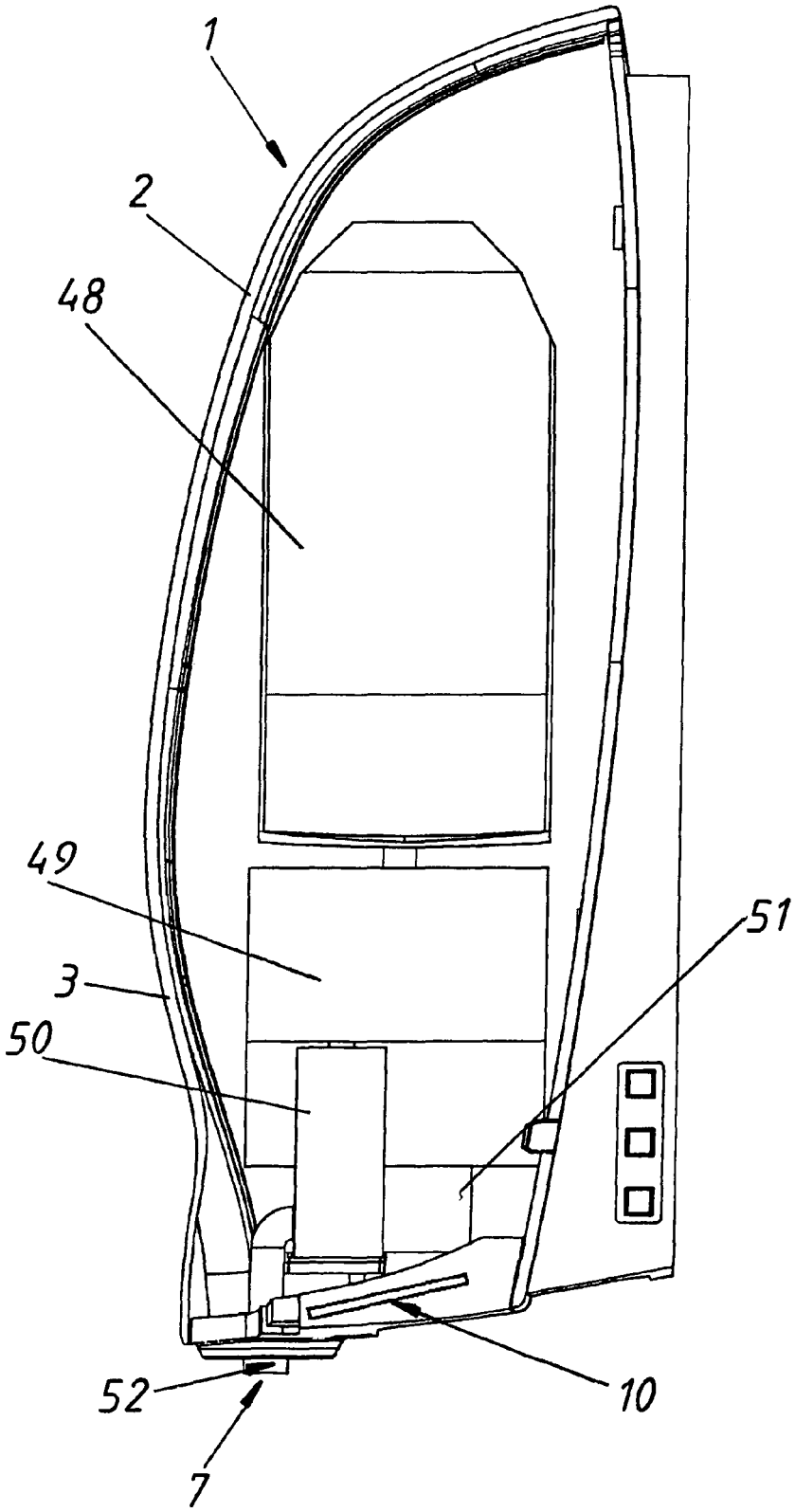
FIG. 7 is a cross-sectional view of the sanitary dispenser according to the invention designed as a soap dispenser.

FIG. 7 illustrates a cross section of the sanitary dispenser 1 according to the invention designed as a soap dispenser. The sanitary dispenser 1 contains a tank 49 with the liquid soap, wherein further sanitary product, i.e. further soap, can be fed into the tank 49 via a refill container 48. A capacitive sensor 10 according to the invention is arranged on the underside of the housing 3. As soon as a user's hand 21 advances up to the sensor area, an electric motor is activated, and this activates an air pump 50 and a soap pump 51. The dispenser opening 7 is provided with a foam generator 52, by which the air taken in by the air pump 50 is mixed with the soap, which is taken in by the soap pump 51, and therefore soap foam passes out through the dispenser opening 7, Of course, the sanitary dispenser according to the invention is not restricted to the exemplary embodiments illustrated in the figures, nor should it be limited by the same. In particular all electrically actuated sanitary dispensers, for example paper dispensers, hand-towel dispensers, soap dispensers, disinfectant dispensers and the like, are covered by the following claims.

The invention claimed is:

1. A sanitary dispenser, comprising:

a housing from which a sanitary product can be dispensed and defining a housing interior;

a capacitive sensor disposed in said housing;

a dispensing unit for dispensing the sanitary product to be dispensed and disposed in said housing, said dispensing unit having an electric motor activated in a contactless manner by said capacitive sensor from outside said housing; and a sensor capacitance of said capacitive sensor formed by a planar electrode disposed in said housing interior, and at least one of a surface of a part of a body or of an object disposed outside said housing;

said capacitive sensor having an oscillating circuit and said planar electrode is part of said oscillating circuit, said oscillating circuit further having a comparator with an output and inputs and a diode connected between one of said inputs of said comparator and said output, said diode assisting in charging and discharging of said capacitive sensor.

2. The sanitary dispenser according to claim 1, wherein said planar electrode is formed by a continuous metal layer.

3. The sanitary dispenser according to claim 1, wherein said planar electrode has a surface area of more than 15 $cm^2$.

4. The sanitary dispenser according to claim 3, wherein the sanitary dispenser is selected from the group consisting of a paper-towel dispenser and a hand-towel dispenser.

5. The sanitary dispenser according to claim 3, wherein said planar electrode has a surface area of more than 25 $cm^2$.

6. The sanitary dispenser according to claim 1, wherein said housing has a housing wall and said planar electrode is disposed directly behind said housing wall and extends, at least in certain regions, parallel to said housing wall.

7. The sanitary dispenser according to claim 1, wherein said housing has a front housing side and said planar electrode is disposed immediately behind said front housing side.

8. The sanitary dispenser according to claim 1, wherein said oscillating circuit is a relaxation oscillator.

9. The sanitary dispenser according to claim 8, wherein said relaxation oscillator has precisely one said comparator.

10. The sanitary dispenser according to claim 1, wherein said capacitive sensor has an evaluation unit configured such that it is possible to determine a change over time in the sensor capacitance.

11. The sanitary dispenser according to claim 10, wherein said evaluation unit is configured such that the change over time in the sensor capacitance can be determined by measuring at least one of a charging period or a discharging period of said planar electrode and comparing the same with a reference time.

12. The sanitary dispenser according to claim 1, wherein a sensitivity of said capacitive sensor can be adjusted.

13. The sanitary dispenser according to claim 1, further comprising a battery for power-supply purposes.

14. The sanitary dispenser according to claim 1, wherein said housing has a front dispenser opening formed therein and said planar electrode is disposed in a region of said front dispenser opening.

15. The sanitary dispenser according to claim 1, wherein a sensitivity of said capacitive sensor can be adjusted in a stepless manner.

16. A method of dispensing sanitary products using a sanitary dispenser, the sanitary dispenser containing a dispensing unit for a sanitary product which can be dispensed and operated by an electric motor, a capacitive sensor and an evaluation unit, the capacitive sensor having a planar electrode for forming a sensor capacitance with at least one of a surface of a part of a body or of an object disposed outside the sanitary dispenser, which comprises the steps of:

determining a change over time in the sensor capacitance;

storing a lower limit and an upper limit for the change over time of the sensor capacitance in an electronic memory in the sanitary dispenser; and activating the electric motor of the dispensing unit of the sanitary dispenser in dependence on the change over time in the sensor capacitance, and activating the electric motor of the dispensing unit only when the change over time in the sensor capacitance lies between the lower limit and the upper limit.

17. The method according to claim 16, which further comprises activating the electric motor of the dispensing unit only when, within a time interval, stored in the electronic memory in the sanitary dispenser, before and after the change over time in the sensor capacitance which lies between the lower limit and the upper limit, the sensor capacitance has same values.

18. The method according to claim 16, which further comprises activating the electric motor of the dispensing unit only when, after an increase in the sensor capacitance which lies between the lower limit and the upper limit, the sensor capacitance decreases by an amount which lies between the lower limit and the upper limit.

19. The method according to claim 18, which further comprises comparing at least one of the charging period or the discharging period with a reference time.

20. The method according to claim 16, which further comprises adjusting at least one of the lower limits or at least one of the upper limits.

21. The method according to claim 16, which further comprises detecting at least one of a charging period or a discharging period for the planar electrode.

* * * * *